United States Patent [19]

Sorrell

[11] Patent Number: 4,647,137

[45] Date of Patent: Mar. 3, 1987

[54] LAMP BASE CONNECTOR ASSEMBLY

[75] Inventor: Malcolm E. Sorrell, Norwalk, Conn.

[73] Assignee: Voltarc Tubes, Inc., Fairfield, Conn.

[21] Appl. No.: 716,017

[22] Filed: Mar. 26, 1985

[51] Int. Cl.[4] ..... H01R 33/02

[52] U.S. Cl. ..... 339/144 T; 339/145 T; 339/176 L

[58] Field of Search ..... 339/144 R, 144 T, 145 R, 339/154 L, 176 R, 206 L, 220 L, 143 T, 145 T, 155 T, 210 T, 220 T, 31 L, 91 L, 110 L, 119 L, 176 L, 177 L

[56] References Cited

U.S. PATENT DOCUMENTS

| | | | |
|---|---|---|---|
| 1,355,301 | 10/1920 | Benjamin | 339/220 L |
| 2,301,914 | 11/1942 | Gaun et al. | 339/144 T |
| 2,340,062 | 1/1944 | Kulka | 339/220 L |
| 2,716,742 | 8/1955 | Szafran et al. | 339/145 |
| 3,109,054 | 10/1963 | Kuhnapfel | 339/145 T |
| 3,126,160 | 3/1964 | Berger | 339/176 L |
| 3,431,540 | 3/1969 | Kopelman et al. | 339/145 T |
| 3,478,300 | 11/1969 | Griffin | 339/145 R |
| 3,912,851 | 10/1975 | Vrijssen et al. | 339/144 R |
| 4,243,907 | 1/1981 | Kohl et al. | 339/144 R |
| 4,396,860 | 8/1983 | Hellwig et al. | 339/144 R |

FOREIGN PATENT DOCUMENTS

| | | | |
|---|---|---|---|
| 0434272 | 5/1924 | Fed. Rep. of Germany | 339/145 R |
| 2527208 | 1/1976 | Fed. Rep. of Germany | 339/176 L |

*Primary Examiner*—Gil Weidenfeld
*Assistant Examiner*—Thomas M. Kline
*Attorney, Agent, or Firm*—Pennie & Edmonds

[57] ABSTRACT

A lamp base assembly and a method for making such an assembly having a first end adapted to receive a lamp housing and a second end adapted to receive electrical contact means for connecting the internal filament of the lamp to an external source of electrical current. The lamp base assembly includes a metal sleeve in which the lamp housing and electrical contact means are mounted. The lamp housing is received at a first end of the sleeve and the electrical contact means are mounted at a second end. A non-conductive insulator is mounted at the second end of the sleeve and isolates the contact means from the sleeve. Stop means are provided to hold the insulator against axial movement through the second end of the sleeve. A cup-shaped retainer means is provided within the sleeve with its bottom in contact with the insulator and urging the insulator against said stop means.

7 Claims, 2 Drawing Figures

LAMP BASE CONNECTOR ASSEMBLY

BACKGROUND OF THE INVENTION

1. Field of The Invention

The invention relates to lighting fixtures and in particular to lamp base assemblies for electric lighting and a method for making such lamp bases.

2. Background Art

In the area of lamp bases and their manufacture, it is known for the lamp base to be molded out of plastic. However, a plastic lamp base connector has, in some situations, severe limitations. Deterioration of the plastic can be caused by ultraviolet radiation, reactions to ozone, and reactions to temperature. For example, exposure to ultraviolet radiation can cause significant deterioration of the resins and loss of structural integrity. This deterioration is enhanced by elevated temperature. Exposure to ozone causes heavy oxidation of the resins, resulting in color loss and change in molecular structure. Upon long-term exposure to high temperatures, such as are present in typical water purification applications, these resins degrade to a grey ash. In addition, temperature exceeding 350° F. can cause the plastic to deform and burn. The deterioration of the base can be severe enough to allow the base to fall off the end of the lamp housing. It is therefore an object of this invention to provide an improved lamp base assembly and method for making an improved lamp base assembly which is resistive to the effects of such an envirionment.

SUMMARY OF THE INVENTION

The invention relates to lamp base assemblies of the type adapted to receive a lamp housing, such as a glass tube, and electrical contact means for connecting the internal filament of the lamp housing to an external source of electrical current. The lamp base assembly includes a metal sleeve in which the lamp housing and contact means are mounted.

A non-conductive insulator is located in the sleeve. The insulator isolates the contact means from the sleeve, and also includes means to support the contact means in the end of the sleeve.

Disposed within the sleeve is a retainer means. The retainer means comprises a cup-shaped metal member having its bottom abutting against the insulator. The side wall of the retainer means engages against the internal wall of the sleeve to hold the retainer means against axial movement within the sleeve.

In the preferred embodiment of the invention, the retainer means has a pre-assembled outside diameter at its top which is larger than the internal diameter of the sleeve. This facilitates cold welding the retainer means to the internal wall surface of the sleeve as the retainer means is forced axially in the sleeve.

To further improve the assembly, the insulator is provided with an irregular surface facing the retainer means. The bottom of the cup-shaped retainer is deformed to this irregular surface so as to prevent rotation of the insulator within the sleeve.

The invention also includes the method of constructing the lamp base assembly. The method includes the steps of securing the electrical contact means to the insulator, mounting the insulator within the sleeve against movement axially through the end and with the electrical contact means electrically insulated from the sleeve. The deformable, metal, cup-shaped retainer member is then inserted within the sleeve. The side wall of the retainer means is moved axially along the internal wall of the sleeve to deform the side wall of the retainer means to the internal wall dimension of the sleeve and to cold weld the side wall of the retaining means to the internal wall of the sleeve.

DESCRIPTION OF THE PREFERRED EMBODIMENT

Figure 1:
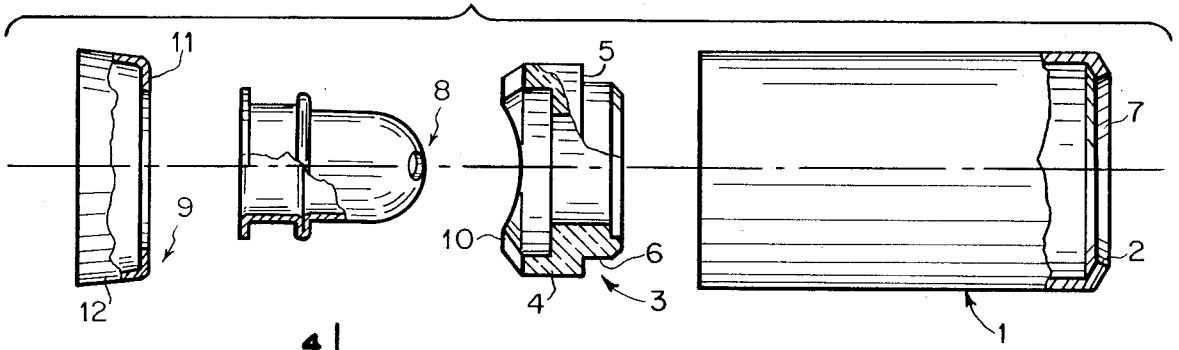
FIG. 1 is an exploded view showing the parts of the lamp base assembly.

The lamp base assembly includes a sleeve 1 which is cylindrical in shape having a first end adapted for receiving a lamp housing such as a glass tube and a second end for receiving and holding contact means. The sleeve is made of aluminum and may be anodized aluminum and has a small portion of narrowing internal dimension which produces a shoulder 2 at the second end thereof. The shoulder 2 may be formed by any method known to those in the art, e.g., peening. Preferably the shoulder projects inwardly of the sleeve at an angle of approximately 30° to a plane transversing the sleeve 1 perpendicular to the sleeve axis.

Disposed within the sleeve is a ceramic insert or insulator 3 for receiving electrical contact means. Insulator 3 has a generally cylindrical portion 4 which is of a diameter which permits a snug fit within the sleeve 1. Insulator 3 has a flat portion 5 which runs inwardly at an angle to the internal surface of the sleeve 1. In the preferred embodiment, the angle is approximately 90°. However, an angle matching the angle of the shoulder 2 of the sleeve can be used so the flat portion 5 and the the shoulder are in face-to-face contact. The insulator has a portion 6 which is also cylindrical but of small enough dimension to fit through the opening 7 in sleeve 1 as defined by the shoulder 2. In this way a portion of insulator 3 extends beyond the sleeve and electrically insulates the electrical contact means from the sleeve. In the embodiment shown in the drawings, the contact means is a single pin element 8. It is to be understood, however, that a dual pin contact or a contact of other configuration can be used. The shoulder 2 acting as a stop and flat portion 5 of the insulator cooperate to prevent the insulator from being forced out of the shouldered end of sleeve 1.

To hold insulator 3 against the shoulder 2, a retainer 9, made of aluminum, is disposed within sleeve 1 and pressed against the insulator 3 such that it sandwiches the insulator 3 between itself and shoulder 2. In order to hold insulator 3 and prevent rotational movement of insulator 3 relative sleeve 1, which is particularly important with a dual pin contact means, the surface 10 of insulator 3 which faces the retainer 9 is irregular or undulating. The retainer itself is cylindrical with an annular lip 11, which engages against the surface 10 of the insulator. The lip 11 of the retainer 9 closely follows the irregular or undulating path of the surface 10 of the insulator. This prevents the insulator 3 from rotating relative to retainer 9.

The retainer 9 is cold welded to the sleeve, as will be explained below, and therefore the retainer, sleeve and insulator cannot move in any way relative to each other.

In constructing the base assembly, the insulator 3 with the contact pin in place is placed in the proper orientation and slid into the sleeve 1. Sleeve 1 already has shoulder 2 on it which acts as a stop to prevent insulator 3 from sliding out the end of sleeve 1.

Next, the retainer member is inserted into the sleeve behind the insulator. The retainer is initially formed as a cup-shaped member with a tapered side wall or skirt 12. The skirt tapers slightly toward the bottom of the retainer with the outside diameter of the retainer at the bottom adjacent the annular shoulder 11 being equal to, or slightly smaller than, the internal dimension of the sleeve 1. Because the outside diameter of the skirt 12 increases slightly as it extends away from the annular shoulder, the side wall of the retainer will be deformed as it is forced axially into the sleeve and along its inner wall surface.

Figure 2:
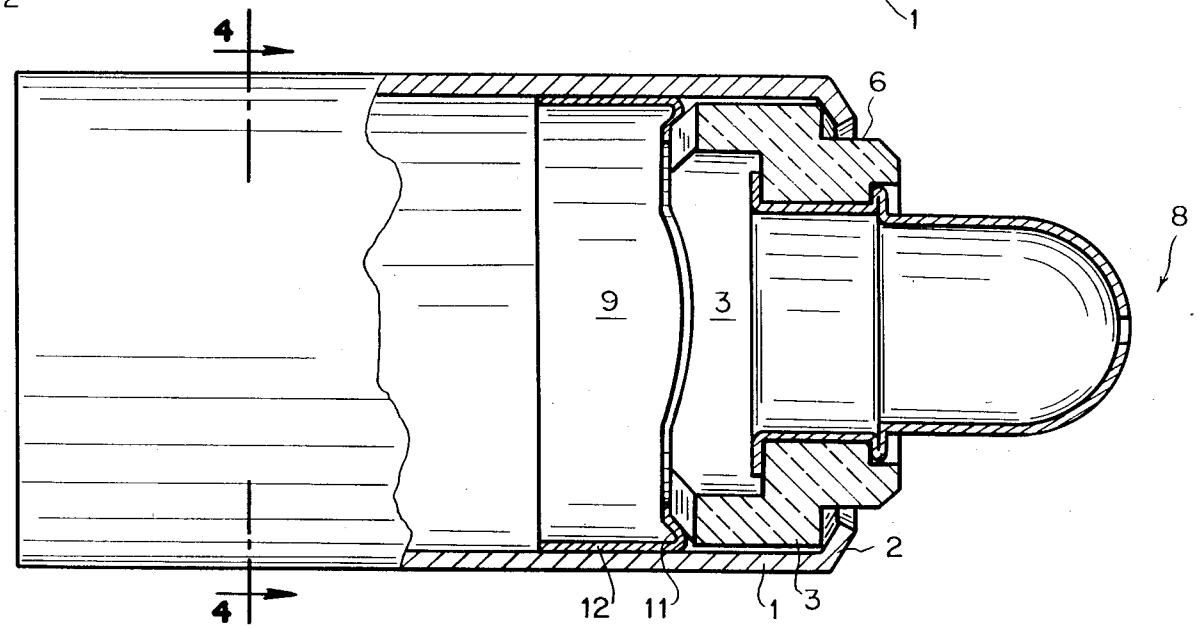
FIG. 2 is a partial cross-sectional side view of the assembled lamp base assembly.

The retainer, made of aluminum, has a wall thickness of about 0.01 inches. With this construction and the accompanying deformation of its side wall as it is moved axially within the sleeve, it becomes cold welded to the inner wall of the sleeve. Thus, once in place, as shown in FIG. 2, it cannot move axially or rotatively and accordingly securely holds the insulator fixed within the sleeve.

The retaining element 9 is slid into sleeve 1 and positioned so that its annular shoulder 11 abuts the surface 10 of the insulator 3 when insulator 3 is fully inserted into sleeve 1. A hard rubber tool of cylindrical shape is then inserted within the retainer and an impulse force is applied to the tool, for example, by a hammer. The force deforms the shoulder 11 of the retainer so it conforms to the undulating configuration of the surface 10 of insulator 3. The force compresses the rubber tool slightly such that it deforms outward and plastically deforms retainer 9. The edge of skirt 12 of the retainer at the open end of the retainer also digs into the sleeve wall thus further preventing retainer 9 from being removed and providing a tight assembly.

The lamp base assembly as described above is ready to receive a glass tube and be further processed ito a lamp via methods known in the art.

I claim:

1. In a lamp base assembly having a first end adapted to receive a lamp housing and a second end adapted to receive electrical contact means for connecting the internal filament of the lamp to an external source of electric current, the improvement comprising:

(a) a metal sleeve in which the lamp housing and contact means are mounted at said first and second ends, respectively;

(b) a non-conductive insulator located in said sleeve at the second end thereof with a first end facing the second end of the sleeve and a second end facing in the opposite direction and electrically isolating said contact means from said sleeve;

(i) said insulator including means for supporting said contact means at the second end of the sleeve;

(c) stop means for holding said insulator against movement axially through the second end of the sleeve; and (d) retainer means disposed within said sleeve at the second end of the insulator, said retainer means comprising:

(i) a cup-shaped metal member having its bottom abutting the second end of the insulator and urging it against the stop means and its side wall engaged against the internal wall of the sleeve to hold the retainer means against axial movement within the sleeve.

2. The improvement in the lamp base assembly according to claim 1 wherein:

(a) the sleeve is cylindrical in shape;

(b) the retainer means is a deformable cup-shaped metal member having:

(i) a pre-assembled outside diameter at its top which is larger than the internal diameter of the sleeve, and (ii) is secured to the internal wall surface of the sleeve against both axial and rotative movement.

3. The improvement in the lamp base assembly according to claim 2 wherein:

(a) the second end of the insulator has an irregular surface facing the retainer means; and (b) the bottom of the cup-shaped retainer means is deformed to said irregular surface to prevent rotation of the insulator within said sleeve.

4. The improvement in the lamp base assembly according to claim 3 wherein:

(a) the sleeve is constructed of aluminum;

(b) the insulator is constructed of ceramic material; and (c) the retainer means is constructed of aluminum with a wall thickness of about 0.01 inches.

5. The improvement in the lamp base assembly according to claim 3 wherein:

(a) the bottom of the cup-shaped retainer means is open in the center thereof to define annular peripheral lip which is deformed to the irregular surface of the insulator.

6. The improvement in the lamp base assembly according to claim 5 wherein:

(a) the second end of the insulator is annular with a peripheral undulating surface facing the lip of the retainer means.

7. The improvement in the lamp base assembly according to claim 6 wherein:

(a) the annular end of the insulator has an outer chamferred surface; and (b) the lip of the bottom of the cup-shaped retainer means is deformed to both the undulating and chamferred surfaces of the insulator.

* * * * *